US007673665B2

(12) United States Patent
Rossato

(10) Patent No.: US 7,673,665 B2
(45) Date of Patent: Mar. 9, 2010

(54) CORDLESS FLEXIBLE WINDOW COVERING

(75) Inventor: Alejandro Martin Rossato, Greensboro, NC (US)

(73) Assignee: Newell Window Furnishings, Inc., High Points, NC (US)

( * ) Notice: Subject to any disclaimer, the term of this patent is extended or adjusted under 35 U.S.C. 154(b) by 181 days.

(21) Appl. No.: 11/781,981

(22) Filed: Jul. 24, 2007

(65) Prior Publication Data

US 2008/0173412 A1 Jul. 24, 2008

Related U.S. Application Data

(60) Provisional application No. 60/881,331, filed on Jan. 19, 2007.

(51) Int. Cl.
*A47H 5/00* (2006.01)

(52) U.S. Cl. ..... 160/84.01

(58) Field of Classification Search ..... 160/84.01, 160/84.04, 377, 349.1, 378, 381, 387
See application file for complete search history.

(56) References Cited

U.S. PATENT DOCUMENTS 5,566,736 A 10/1996 Crider et al.
5,785,105 A 7/1998 Crider et al.
6,769,471 B2 8/2004 Voss et al.
7,086,446 B2 8/2006 Kollman et al.
2004/0060670 A1 4/2004 Judkins
2006/0102293 A1* 5/2006 Wu ..... 160/84.01
2008/0149284 A1* 6/2008 Lin ..... 160/377
2008/0179016 A1* 7/2008 Lin ..... 160/84.01

* cited by examiner

*Primary Examiner*—Blair M. Johnson
(74) *Attorney, Agent, or Firm*—Dennis J. Williamson; Moore & Van Allen, PLLC

(57) ABSTRACT

A window covering comprises a flexible panel having a top edge and a bottom edge. At least one lift cord is provided for raising and lowering the bottom edge. Each lift cord is connected to one end of a stiffener at a first point and the opposite end of the stiffener is connected to approximately the bottom edge of the flexible panel. The stiffener prevents the folding of the flexible panel between the bottom edge and the first point. The top edge may be connected to a head rail and the bottom edge may be connected to a bottom rail. A motor may be located adjacent the top rail where the lift cord is connected to the motor.

15 Claims, 12 Drawing Sheets

CORDLESS FLEXIBLE WINDOW COVERING

This application claims the benefit of priority under 35 U.S.C. § 119(e) to the filing date of U.S. Provisional Application 60/881,331 filed on Jan. 19, 2007, which is incorporated herein by reference in its entirety.

BACKGROUND OF THE INVENTION

The invention relates generally to cordless window coverings and more particularly to cordless window coverings having relatively soft, flexible panels.

Window coverings having flexible panels such as woven wood shades, natural shades, Roman shades, hobbled shades, looped shades, and the like are known. Likewise, cordless window coverings are also known. Cordless window coverings typically comprise a spring motor connected to the top or bottom of the window covering. The spring motor offsets the weight of the shade panel to hold the shade panel in any vertical position. To operate the window covering, a user pushes up or pulls down on the bottom rail (or top rail in the case of a top down shade) of the shade panel to raise or lower the shade. The spring motor assists in the raising of the shade panel and holds the shade panel in the desired position. Typically, the shade panels in cordless window coverings are comprised of cellular shades.

SUMMARY OF THE INVENTION

A window covering comprises a flexible panel having a top edge and a bottom edge. At least one lift cord is provided for raising and lowering the bottom edge. Each lift cord is connected to one end of a stiffener at a first point and the opposite end of the stiffener is connected to approximately the bottom edge of the flexible panel. The stiffener prevents the folding of the flexible panel between the bottom edge and the first point. The top edge may be connected to a head rail and the bottom edge may be connected to a bottom rail. A motor may be located adjacent the top rail where the lift cord is connected to the motor.

DETAILED DESCRIPTION OF EMBODIMENTS OF THE INVENTION

Figure 1:
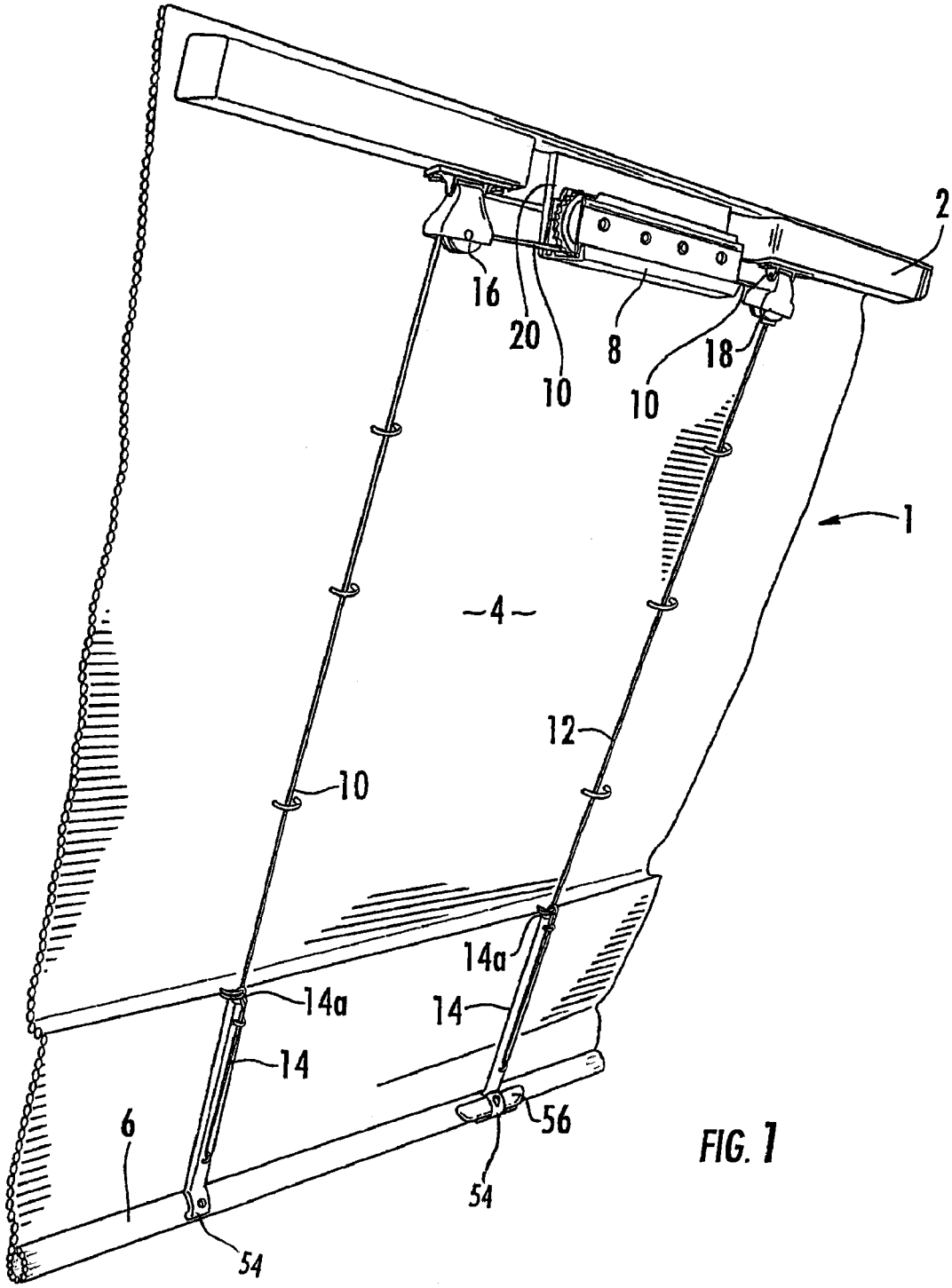
FIG. 1 is a perspective back view of an embodiment of the window covering of the invention.
Figure 2:
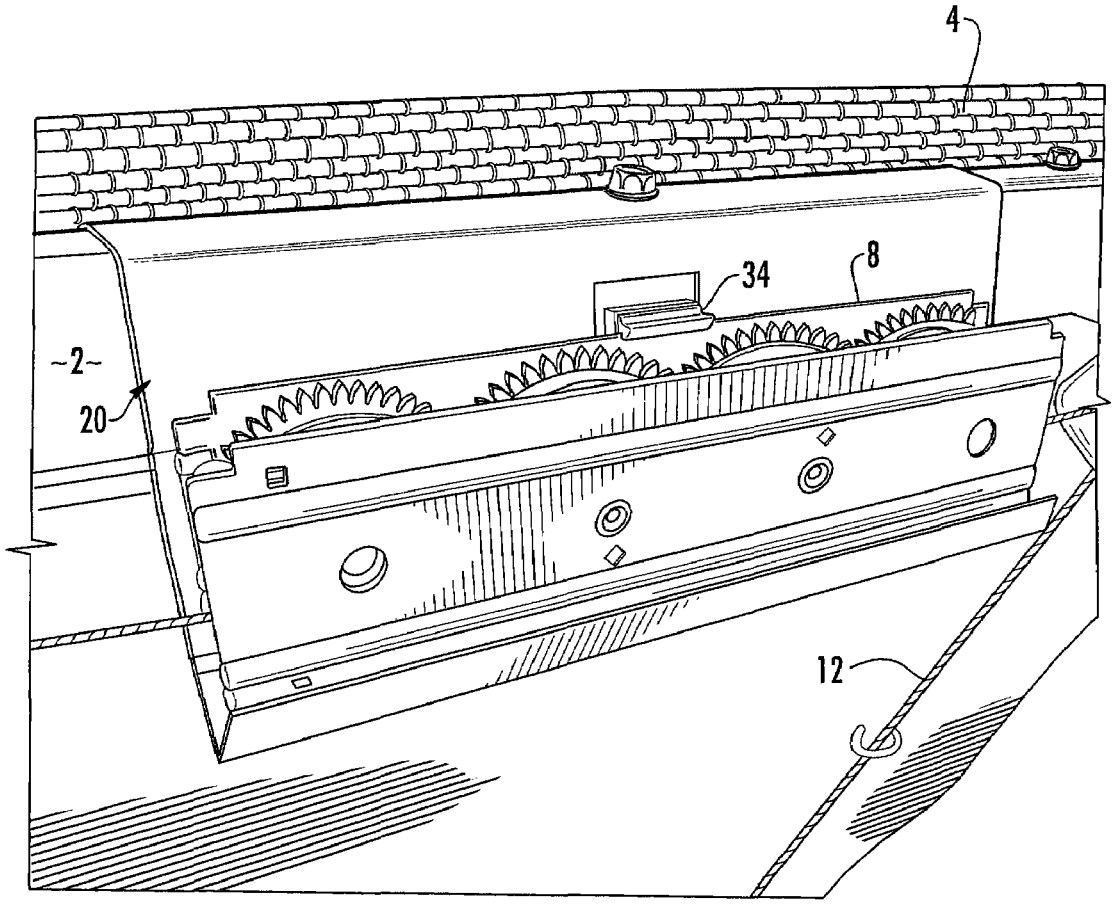
FIG. 2 is a perspective view showing the spring motor mounted on an embodiment of the window covering of the invention.
Figure 3:
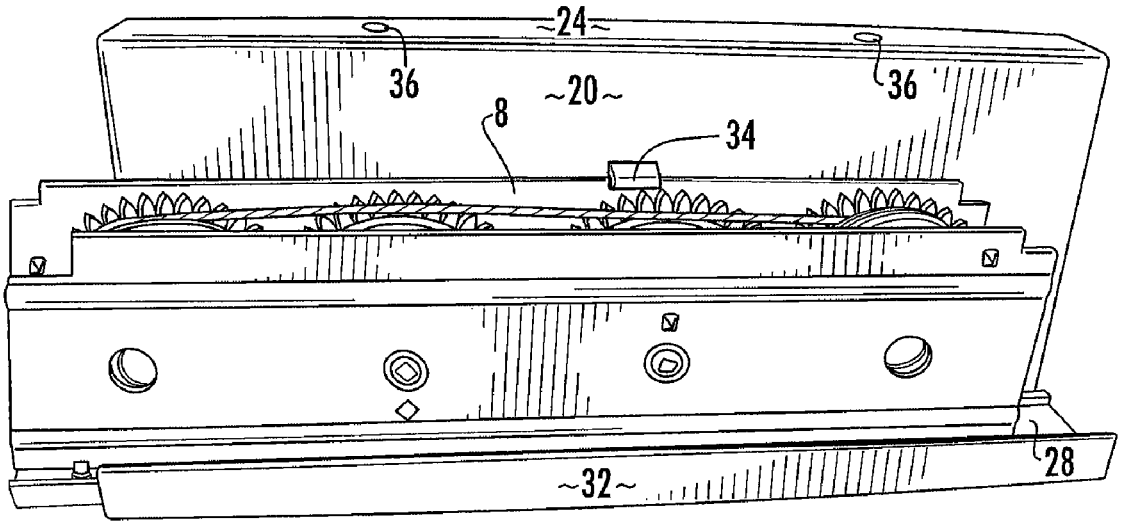
FIG. 3 is a perspective view showing the spring motor and an embodiment of a mounting bracket of the invention.
Figure 4:
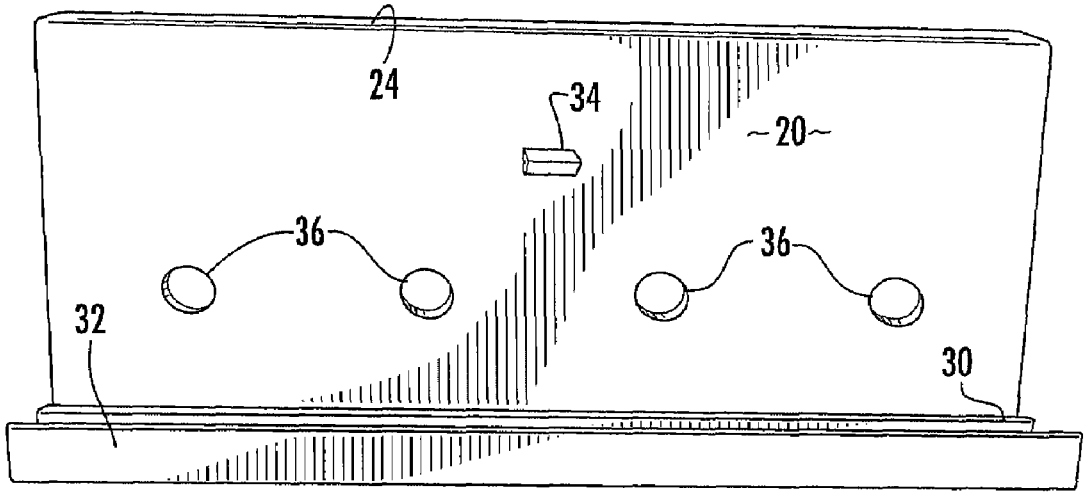
FIG. 4 is a front view showing the mounting bracket of FIG. 3.

The window covering is shown generally at 1 in the drawings and comprises a head rail 2 supporting a flexible shade panel 4 that has a bottom rail 6 located at the lower edge of the panel 4. The front of the head rail 2 is covered by the shade panel 4 such that it is hidden from view when the window covering is viewed from the front. The bottom rail 6 may be covered in the shade panel fabric such that it is hidden from view. The flexible shade panel 4 may comprise woven wood shades, natural shades, Roman shades, hobbled shades, looped shades, or the like where the shade panel is made of a relatively flexible material. The head rail 2 and shade panel 4 are typically dimensioned to coincide with the dimensions of the architectural feature with which the window covering is intended to be used. While the invention is referred to as a window covering and may be used primarily to cover windows, it is to be understood that the invention may be used to cover any architectural feature such as a window, door, opening, alcove or the like.

The upper end of the panel 4 is secured to the head rail 2 such that the head rail extends for substantially the width of the panel. The head rail 2 may comprise a rigid material such as a wood or metal member and may be formed as a solid member as shown or may be formed as hollow or U-shaped member.

A spring motor 8 such as described in U.S. Pat. No. 6,149,094, dated Nov. 21, 2000 and U.S. Pat. No. 6,318,661, dated Nov. 20, 2001, which are incorporated in their entirety by reference herein, is mounted to the head rail 2. Lift cords 10 and 12 extend from the spring motor 8 to stiffeners 14. Stiffeners 14 are connected to the bottom rail 6 of the shade panel 4 as will hereinafter be explained. Spring motor 8 assists in the raising of the shade panel 4 and serves to hold the shade panel 4 in any desired raised position. While the illustrated embodiment shows a single spring motor connected to two lift cords, a greater number of lift cords and spring motors may be used depending upon the size, weight and geometry of the window covering. The lift cords may pass through pulleys 16 and 18 that are connected to the head rail 2 to space the lift cords a desired distance on the shade panel and to facilitate the lifting of the shade.

Figure 5:
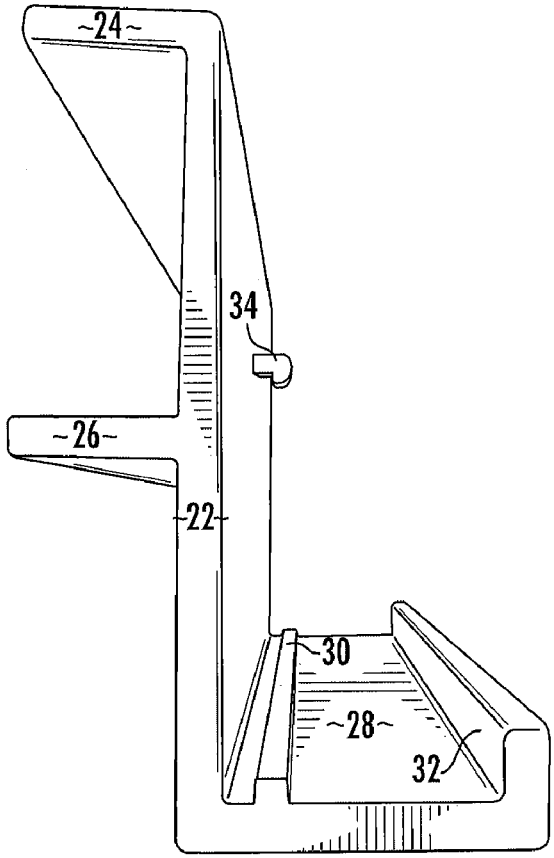
FIG. 5 is a perspective side view showing the mounting bracket of FIG. 3.
Figure 6:
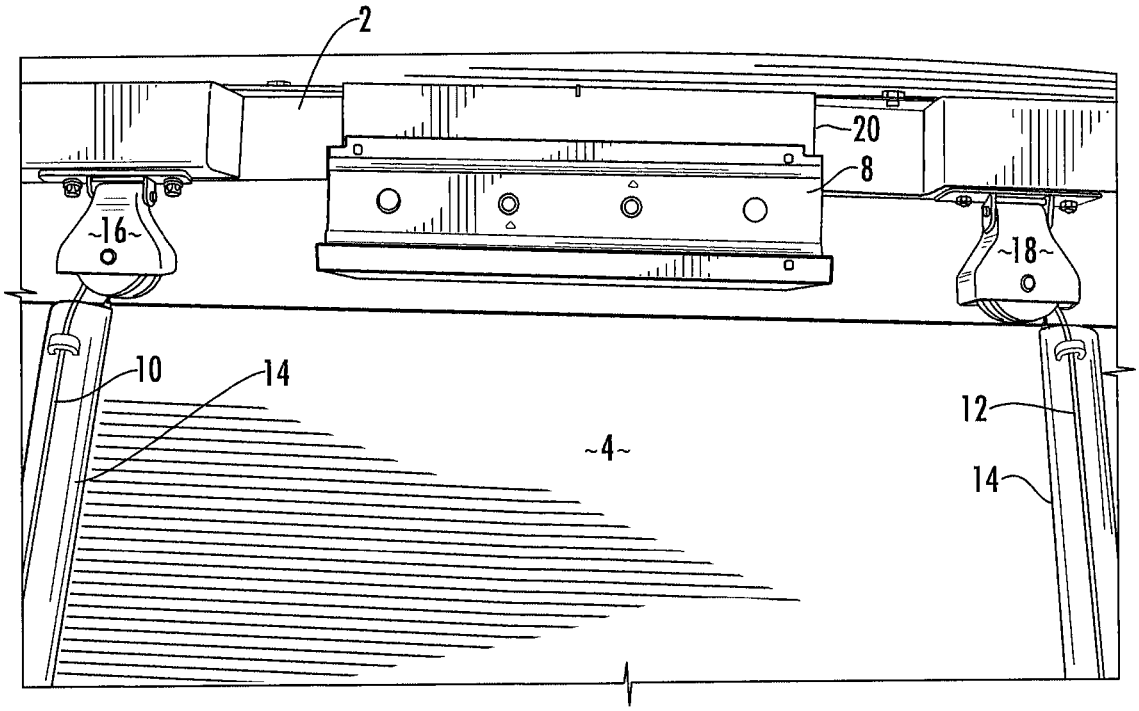
FIG. 6 is a partial back view showing an embodiment of the window covering of the invention.
Figure 7:
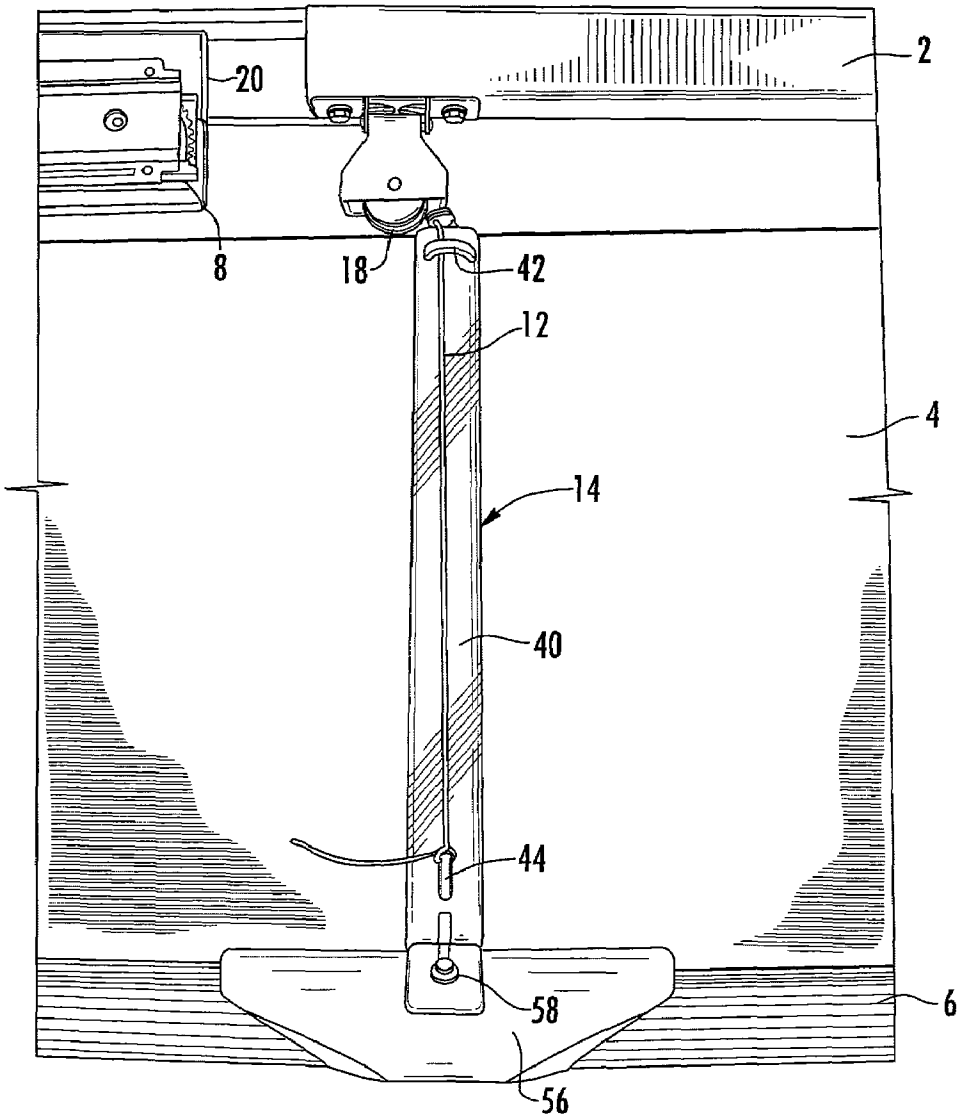
FIG. 7 is a partial back view showing an embodiment of the stiffener used in the window covering of the invention.
Figure 8:
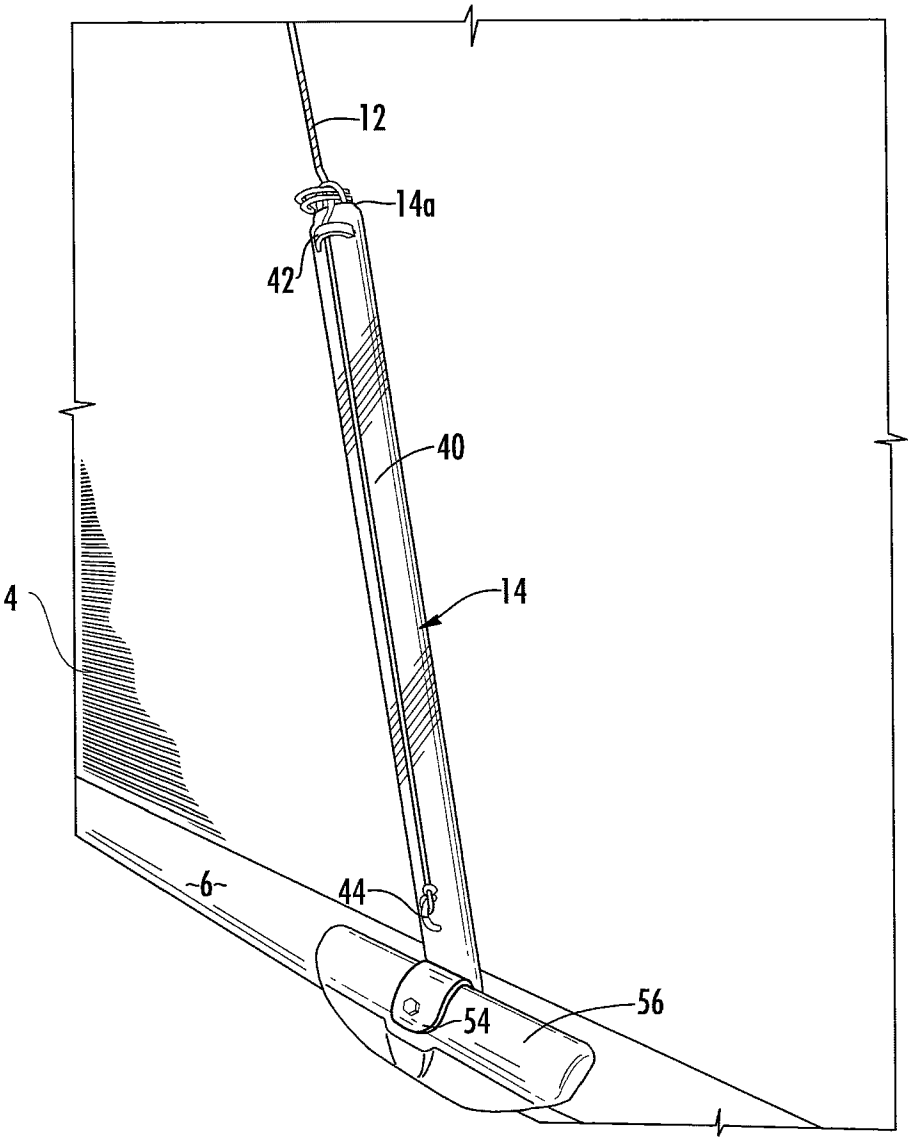
FIG. 8 is a perspective view showing an embodiment of the stiffener used in the window covering of the invention.
Figure 9:
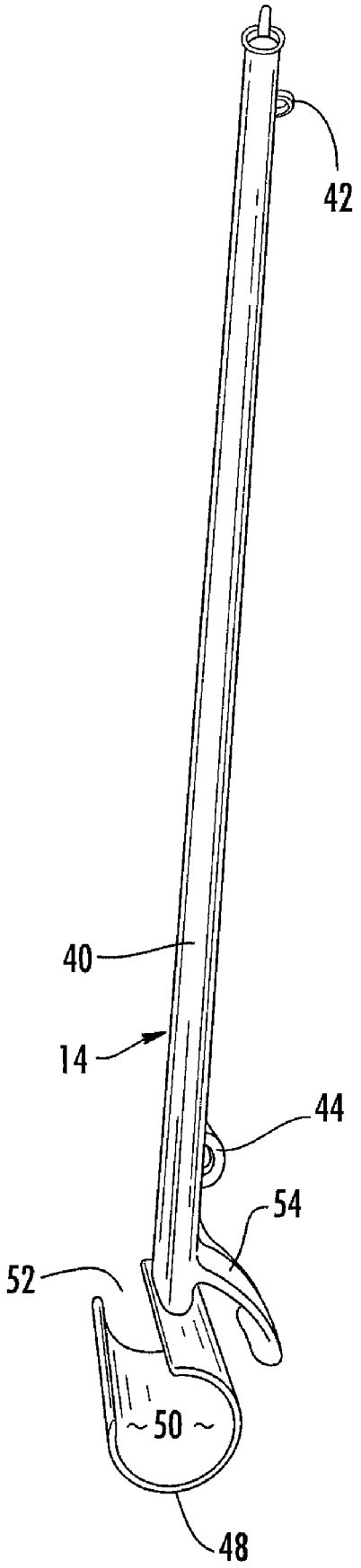
FIGS. 9 and 10 are detailed views of an embodiment of the stiffener of the invention.
Figure 10:
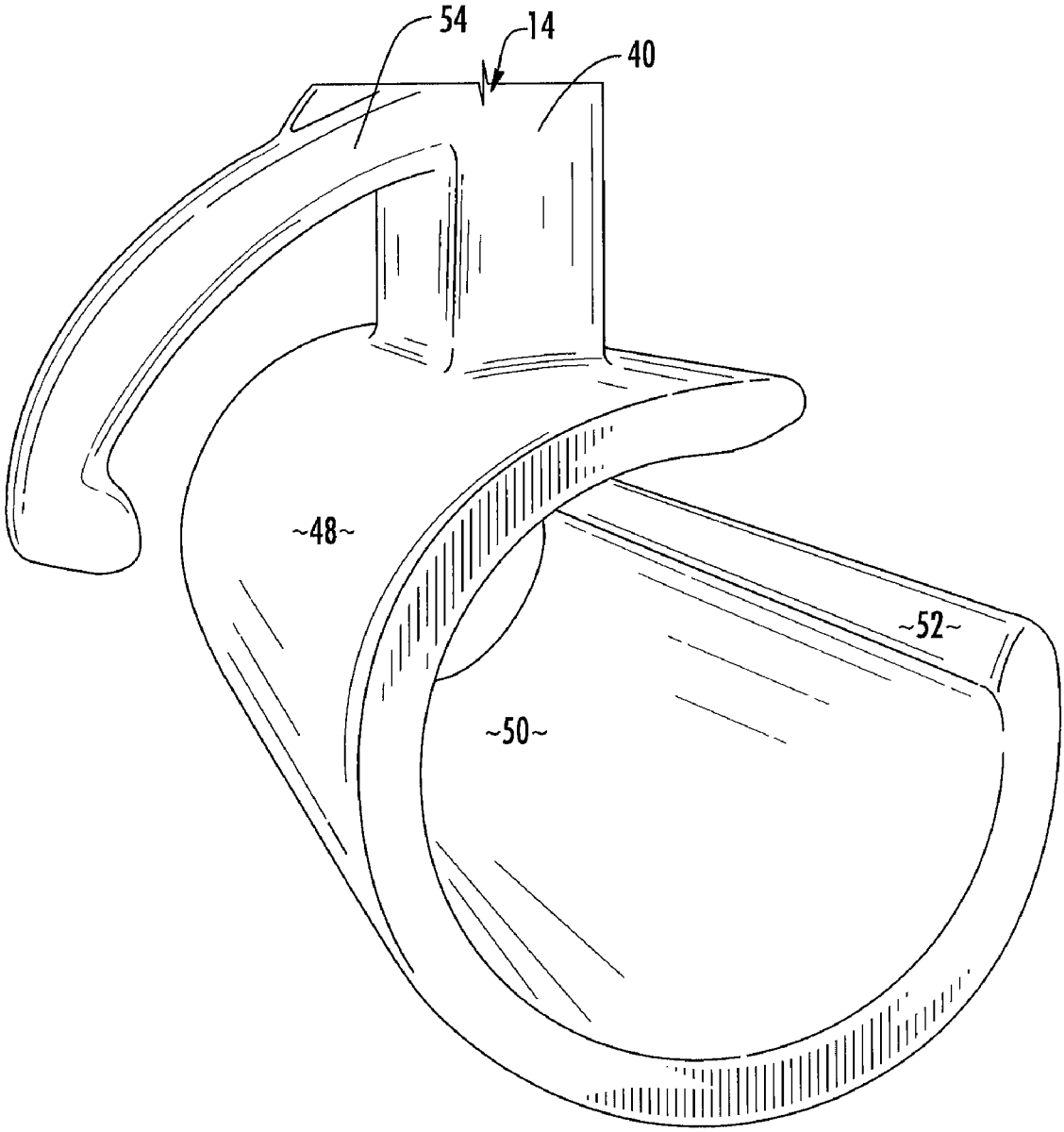

A spring motor support 20 attaches the spring motor 8 to the headrail 2. As best shown in FIGS. 5, 6 and 7 support 20 includes a back flange 22 having first and second flanges 24 and 26 extending thereform. Flanges 24 and 26 are spaced and dimensioned to receive the headrail 2 therebetween. A motor support flange 28 extends from back flange 22 to the side opposite flanges 24 and 26 and defines a support surface on which spring motor 8 rests. Flange 28 may include upwardly extending flanges 30 and 32 for engaging the spring motor. A locking element 34 is formed in the back flange 22 for gripping the upper end of the spring motor to maintain the motor on the support. In one embodiment the motor support 20 is made of a flexible material such as plastic such that the support can flex to allow the motor to be snapped into the support. The support includes apertures 36 for receiving fasters such as screws or rivets for securing the support to the head rail 2.

A device for stiffening the bottom of panel 4 in order to help with the control of the bottom of the shade during the raising and lowering of the shade is provided. The stiffener 14 comprises a rigid member connected between the bottom rail 6 and each of the lift cords 10 and 12 that extend from the spring motor 8. At least the upper edge 14*a* of the stiffener 14 is connected to panel 4. The stiffener 14 helps transfer the motion of the lifting of the bottom of the shade through the entire bottom panel therefore helping control the fabric while the shade is being raised.

Referring to FIGS. 1 and 7 through 10, the stiffener 14 comprises an elongated member 40 that extends generally parallel to lift cords 10 and 12. The elongated member 40 includes a first upper eyelet 42 and a second lower eyelet 44. Each lift cord extends through the upper eyelet 42 and is attached to the stiffener 14 at the lower eyelet 44. In one embodiment the lift cord is tied to the eyelet 44 although the lift cord may be secured to the stiffener 14 by any mechanism.

The elongated member 40 terminates in a sleeve 48 that has an internal shape and dimension to receive the bottom rail. In the illustrated embodiment the bottom rail has a circular cross-section such that the sleeve 48 defines a generally cylindrical internal cavity 50. The bottom rail may have other cross-sectional shapes and the internal cavity 50 would be shaped to match the shape of the bottom rail. The sleeve 48 may be slipped over the bottom rail and includes a gap 52 to allow the sleeve 48 to flex to accept the bottom rail.

Figure 11:
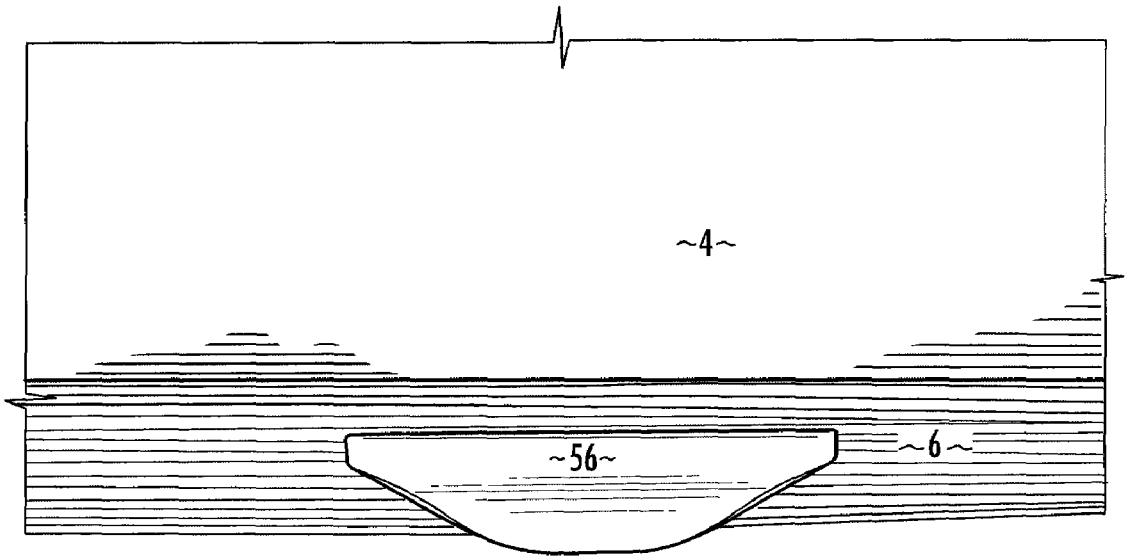
FIG. 11 is a partial front view showing an embodiment of the handle mounted on the shade panel.

A handle support member 54 is provided for supporting a handle 56 on the bottom rail. The support member 54 is spaced from the sleeve a distance sufficient to allow the handle 56 and panel material to fit between the support member 54 and sleeve 48. The support member 54 may be attached to the handle by a fastener that engages aperture 58 and is secured to the bottom rail. The stiffener 14 (and handle 56) can slide onto the shade after the shade is made and secured thereto by a fastener such as a screw, rivet or adhesive. Use of the handle support member 54 allows the handle 56 to be supported on the bottom rail without any visible fasteners showing on the front of the window covering as shown in FIG. 11.

Figure 12:
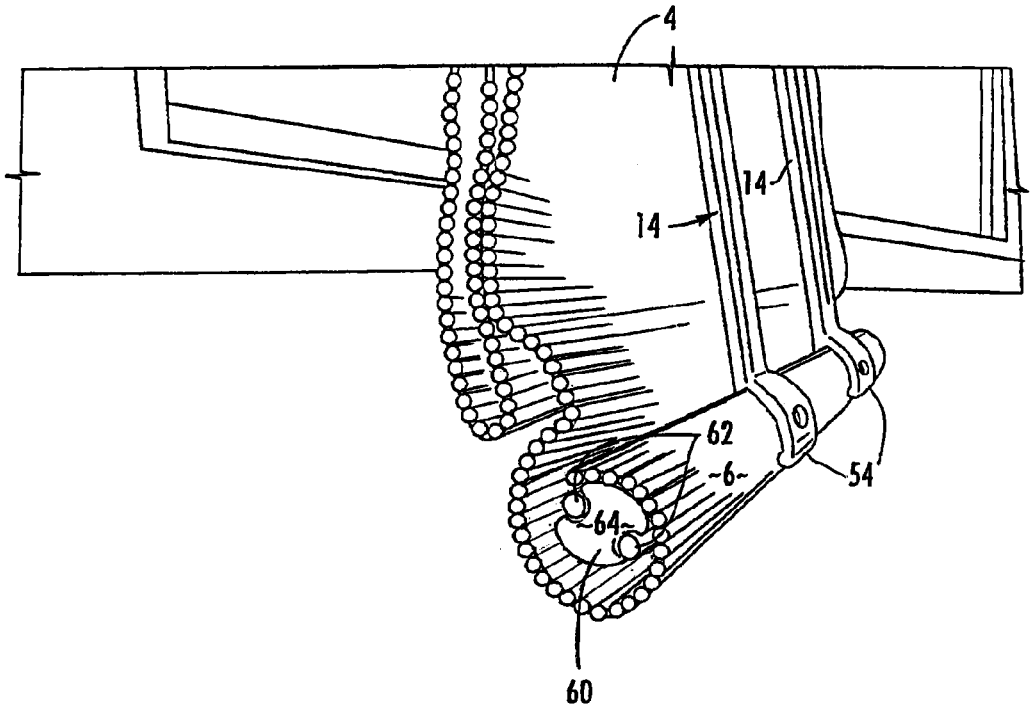
FIG. 12 is a partial perspective side view of an embodiment of the window covering of the invention showing the bottom rail.

Referring to FIG. 12, the bottom rail includes a rigid member 60 that extends for substantially the entire width of the panel. In the illustrated embodiment the member 60 has a circular profile although the member may have any cross-sectional shape. Separate weights 62 may be attached to the bottom rail 6 where the member 60 has longitudinally extending grooves 64 that receive long extruded weights 62 such that the member 60 and weights 62 can be wrapped in the shade panel fabric. The weights 62 may be added to balance the weight of the relatively light flexible panel against the lift force generated by the spring motor 8 depending upon the weight of the flexible panel and the force generated by the spring motor. The weight may also be generated by the bottom rail itself.

In operation, to raise and lower the shade panel the user grasps the bottom rail/handle and exerts either an upward force to raise the panel or a downward force to lower the panel. The use of the stiffeners 14 balances the forces on each of the lift cords. The stiffeners prevent the portion of the panel 4 between the end of the stiffener and the bottom rail (or the top rail in the case of a top down shade) from folding. The stiffeners allow the relatively soft and flexible panel fabric above the stiffeners to fold and drape in a controlled and aesthetically pleasing manner as the bottom rail is raised as shown in FIGS. 1 and 17. Without the stiffeners the flexible panel material would tend to fall below the bottom rail in an uncontrolled manner as the window covering is raised making it difficult for the user to hold and manipulate the bottom rail. Moreover, without the stiffeners the panel will not fold and drape in a controlled and aesthetically pleasing manner.

The stiffeners 14 can also be used on the top edge of a panel of a window covering that is a "top down" or a "top down/bottom up" shade to control the movement of the top of the shade. Top down shades are shades where top of the shade panel may be raised and lowered. The cordless shade can also be made by attaching the motor 8 to the bottom of the shade panel and adding a braking mechanism so that the shade can be raised when the braking mechanism is released.

The stiffeners 14 can be slid onto the bottom rail 6 and the fabric can be wrapped around both the rail and the stiffener. This gives the flexibility to add different handles to the shade. The stiffeners 14 can also slide over the fabric and bottom bar after the bottom bar has been wrapped with the fabric.

Specific embodiments of an invention are disclosed herein. One of ordinary skill in the art will recognize that the invention has other applications in other environments. Many embodiments are possible. The following claims are in no way intended to limit the scope of the invention to the specific embodiments described above.

The invention claimed is:

1. A window covering comprising:

a flexible panel having a top edge and a bottom edge including a bottom rail;

at least one cord for raising and lowering the bottom edge;

at least one rigid stiffener comprising an elongated member having an upper end connected to the shade panel and a lower end, a first eyelet disposed neat the upper end; said at least one cord extending through the first eyelet and connected to said stiffener at a first point disposed near said lower end; and said stiffener including a sleeve defining an internal cavity that receives said bottom rail such that said flexible panel covers at least a portion of said bottom rail and at least a portion of said sleeve; and a handle attached to the stiffener such that said handle is positioned over the flexible panel such that it is exposed.

2. The window covering of claim 1 wherein said stiffener prevents the folding of the flexible panel between said bottom edge and said upper end.

3. The window covering of claim 1 further including at least two lift cords and at least two stiffeners.

4. The window covering of claim 3 wherein said at least two stiffeners prevent the folding of the flexible panel between said bottom edge and said upper end.

5. The window covering of claim 1 wherein said flexible panel comprises a woven material.

6. The window covering of claim 1 wherein said one cord is connected to a motor.

7. The window covering of claim 6 wherein said motor comprises a spring motor.

8. The window covering of claim 7 wherein said spring motor assists in the lifting of said bottom edge.

9. The window covering of claim 1 wherein said bottom rail is weighted.

10. The window covering of claim 1 further including a head rail.

11. The window covering of claim 6 wherein said motor is connected to a head rail.

12. The window covering of claim 11 wherein said motor is snap fit into a holder mounted to the head rail, said holder comprising a support comprising a first flange attached to the head rail and a second flange attached to the first flange, and a locking element on said first flange spaced from the second flange such that the motor rests on said second flange and is gripped between the second flange and the locking element.

13. The window covering of claim 12 wherein said second flanges flexes relative to the locking element to receive the motor therebetween.

14. The window covering of claim 12 wherein said first flange extends generally parallel to the shade panel and the second flange extends generally perpendicular to the first flange and said second flange includes upwardly extending flanges for engaging the motor.

15. The window covering of claim 12 wherein a pair of flanges extend from the first flange for receiving the head rail therebetween.

* * * * *

UNITED STATES PATENT AND TRADEMARK OFFICE

CERTIFICATE OF CORRECTION

PATENT NO. : 7,673,665 B2
APPLICATION NO. : 11/781981
DATED : March 9, 2010
INVENTOR(S) : Alejandro Martin Rossato et al.

It is certified that error appears in the above-identified patent and that said Letters Patent is hereby corrected as shown below:

Column 4, line 27, please delete the word "neat" and add the word "near"

Signed and Sealed this

Fourth Day of May, 2010

David J. Kappos

David J. Kappos
*Director of the United States Patent and Trademark Office*